US005268119A

United States Patent [19]

Simpson et al.

[11] Patent Number: 5,268,119

[45] Date of Patent: Dec. 7, 1993

[54] MACHINE DISHWASHING DETERGENT HAVING A REDUCED CONDENSED PHOSPHATE CONTENT

[75] Inventors: Madeline P. Simpson, Flemington; Raymond S. Brown, Bridgewater; Anthony Winston, East Brunswick; Louis Kubian, Bound Brook, all of N.J.

[73] Assignee: Church & Dwight Co., Inc., Princeton, N.J.

[21] Appl. No.: 775,221

[22] Filed: Oct. 11, 1991

[51] Int. Cl.[5] ..... C11D 3/10; C11D 3/395; C11D 3/06; C11D 3/08

[52] U.S. Cl. ..... 252/95; 252/135; 252/174.14; 252/174.23; 252/174.24

[58] Field of Search ..... 252/135, 174.14, 174.23, 252/174.24, 95

[56] References Cited

U.S. PATENT DOCUMENTS 3,899,436 8/1975 Copeland et al. ..... 252/99
4,092,258 5/1978 McLaughlin et al. ..... 252/99
4,187,190 1/1978 McLaughlin et al. ..... 252/99
4,233,172 11/1980 McLaughlin et al. ..... 252/99
4,379,069 4/1983 Rapisarda et al. ..... 252/135
4,411,810 10/1983 Dutton et al. ..... 252/99
4,853,259 8/1989 Taha ..... 427/221
4,933,101 6/1990 Cilley et al. ..... 252/174.25
4,973,419 10/1990 Romeo et al. ..... 252/135

*Primary Examiner*—Paul Lieberman
*Assistant Examiner*—Kery A. Fries
*Attorney, Agent, or Firm*—Charles B. Barris

[57] ABSTRACT

The present invention is based upon the discovery that high levels of carbonate salts can be formulated with minor concentrations of phosphates (e.g., about 0.1 to 0.3 percent by weight as expressed as ($P_2O_5$) ion) together with low levels of polycarboxylate homopolymers and copolymers (i.e., about 0.5 to 5.0 percent by weight) in a dishwashing detergent formulation while providing satisfactory cleaning without unacceptable spotting and filming and without the need to add a chlorinating agent.

10 Claims, No Drawings

MACHINE DISHWASHING DETERGENT HAVING A REDUCED CONDENSED PHOSPHATE CONTENT

FIELD OF THE INVENTION

This invention relates to a low phosphate machine dishwashing composition. More particularly, this invention relates to an automatic machine dishwashing composition which is extremely low in phosphorus and which more efficiently removes food soils with equivalent spotting and clarity to glassware and dishes as compared to conventional phosphate-built dishwashing compositions and may be free from chlorine.

BACKGROUND OF THE INVENTION

In the detergent industry, distinctions are drawn between cleaning compositions on the basis of their functional utility. For example, there are considerable art-recognized differences between cleaning compositions that are used for laundering purposes; cleaning compositions that are used for machine dishwashing purposes; and cleaning compositions that are used for hand dishwashing purposes. Generally, cleaning composition for laundering purposes employ high foaming organic surfactants as the main cleansing agents. Foaming, unless it is excessive to the extent that it causes overflow from the washing machines, is generally considered beneficial in laundering compositions because it provides an indication to users that the product is working. By way of contrast, machine dishwashing methods which are currently used to wash china, glass, porcelain, ceramic, metal, and hard synthetic articles impart a high mechanical impact of the wash liquid which is sprayed onto the articles to be cleaned. Recently, developments in dishwashing apparatus have been directed toward further increasing the intensity of liquid motion as well as the water volume cycled per minute, so as to further improve the mechanical cleansing effect of the cleansing solution. Machine dishwashing compositions are very low-foaming compositions inasmuch as foam formation interferes with the mechanical action of the dishwasher and reduces the mechanical impact of the liquid sprayed onto the articles to be cleaned. The surface active agents useful for machine dishwashing compositions should not only be low foaming materials, but they should also be foam supressants, so that the foaming caused by protein and food residues in combination with alkaline cleansing solutions is kept to a minimum. This situation, however, is quite different from hand dishwashing compositions, which, preferably, are high foaming and have more the attributes of laundering compositions. Hand dishwashing compositions differ from laundering compositions and machine dishwashing compositions in that they are milder and can be safely used in contact with the skin.

Thus, machine dishwashing detergents constitute a generally recognized class of detergent compositions. In summary, machine dishwashing detergents are mixtures of ingredients whose purpose, in combination, is to emulsify and remove food soils; to inhibit the foam caused by certain food soils; to promote the wetting of dinnerware to thereby minimize or eliminate visually observable spotting; to remove stains such as those caused by coffee and tea; to prevent a buildup of soil films on dinnerware surfaces; to reduce or eliminate tarnishing of flatware; and to destroy bacteria. Additionally, machine dishwashing detergents must possess these characteristics without substantially etching or corroding or otherwise damaging the surface of dinnerware and flatware.

It is conventional to use strongly alkaline solutions in institutional and household dishwashing machines for washing dishes, glasses, and other cooking and eating utensils. Ordinary tap water is used to make up the strongly alkaline cleaning solution and for rinsing purposes subsequent to the cleaning operation. However, spotting on dishes and glassware by hard water and soil residues and precipitates has been a major problem. Currently these problems are minimized in machine dishwashing detergent compositions by the use of relatively high levels of polyphosphates to act as hardness sequestering agents, thus reducing the amount of hard-water deposits and filming on glassware. In addition, these detergents usually contain a chlorine bleaching system for stain removal, sanitization, and an added cleaning boost by oxidizing protienacious soils on glassware. Chlorinating agents also help prevent spotting.

Although the performance of these conventional detergent compositions are quite satisfactory, high phosphate levels have potential environmental drawbacks. Furthermore, the addition of chlorine bleach requires special processing and storage and packaging precautions. Additionally, chlorine bleach imparts an undesirable odor and makes fragrancing the finished product more difficult.

In recent years, increased attention has been focused upon environmental pollution problems (e.g. water pollution). Phosphates have been identified as a contributing factor to eutrophication (i.e. promotion of algae growth) and considerable effort has been devoted to attempts at replacing all or at least some significant part of the alkaline condensed phosphates used in machine dishwashing detergents with chemicals that are more ecologically acceptable. Of the numerous compounds that have been tested as substitutes for alkaline condensed phosphates (particularly as substitutes for sodium tripolyphosphate), very few chemicals have given promising results. Many chemicals lack the desired cleaning ability. Other chemicals lack the building effect of the polyphosphates which promote cleaning even when used at levels lower than that required to sequester all the hard water metal ions present. Still others are as much or more ecologically undesirable and are too expensive to be practical.

It is not conventional to replace the condensed polyphosphates in dishwashing detergents with carbonate salts. Although carbonate salts are effective and economical water softeners, they remove water hardness ions by precipitation and as a result leave unacceptable levels of residue on the dishes, glassware and utensils being washed.

It is desirable, therefore, to provide a moderately alkaline, non-chlorine automatic dishwashing detergent composition which provides excellent glassware spotting and filming results while utilizing relatively low levels of phosphate in the composition. It is especially desirable to provide a detergent composition which imparts glassware cleaning efficacy equal to that of conventional automatic dishwashing detergents which rely on high phosphate levels and chlorine bleach to achieve the same results. It would also be desirable to provide a stable, less alkaline detergent composition which requires no expensive barrier packaging for extended shelf-life stability.

SUMMARY OF THE INVENTION

The present invention is based upon the discovery that high levels of carbonate salts can be formulated with minor concentrations of phosphates (e.g., about 0.1 to 0.3 percent by weight as expressed as ($P_2O_5$) ion) together with low levels of polycarboxylate homopolymers and copolymers (i.e., about 0.5 to 5.0 percent by weight) in a dishwashing detergent formulation while providing satisfactory cleaning without unacceptable spotting and filming and without the need to add a chlorinating agent.

Accordingly, the present invention provides improved automatic dishwasher detergents comprising from about 50 to 95 and, preferably, about 60 to 95.0 percent by weight of alkali metal carbonates and from about 0.10 to 1.5, preferably, from about 0.1 to 0.3 percent by weight (based on ($P_2O_5$) ion content) of alkaline condensed phosphate salts, and from about 0.5 to 5 and, preferably, from about 0.8 to 2.0 percent by weight of a polycarboxylate polymer of from 1,000 to 1,000,000 molecular weight, and, preferably, from 1,500 to 10,000 molecular weight and from 0.5 to about 5.0 percent by weight of a foam-suppressing nonionic surfactant.

While removal of phosphates from conventional dishwashing detergents containing approximately 20 percent by weight carbonate has not been practical due to severe spotting and filming, surprisingly, we have found that virtually all of the phosphate can be removed if polyacrylates are added to the formulation. Indeed, the total level of carbonate can be increased to levels not normally used by adding polyphosphates in levels as low as 0.1 percent ($_2O_5$) and polyacrylate polymers as low as 1.0 percent which significantly reduces spotting and filming due to the carbonates. The use of 0.25 to 0.30 percent ($P_2O_5$) polyphosphate together with 1.0 percent by weight polyacrylate improves performance to the levels seen with high phosphate formulas.

DETAILED DESCRIPTION OF THE INVENTION

Automatic dishwashing detergents ("ADDs") of the present invention are preferably formulated as solid detergents. Although the present invention can be applied to or embodied in various types of machine dishwashing detergents, its greatest advantage is associated with the production of powdered or granular detergent compositions.

The machine dishwashing detergent compositions of the present invention will normally contain at least one alkali metal carbonate salt, a polymer as described above, and an alkaline condensed phosphate salt. However, we have found that in addition to these agents, performance improvements are achieved by the addition of relatively low levels of sodium citrate, or other organic complexing salts, in the range of about 1.0 percent to 10.0 percent by weight. In addition, non-chlorine oxidizing agents in amounts up to about 6.0 percent by weight, with or without activators, can be added to improve efficacy. Examples of these oxidizing agents are persulfates, percarbonates, perborates, and the like.

In use, the amount of detergent composition added to the wash water will preferably be limited so that the dissolved solids of the composition do not exceed about 1 percent by weight of the wash water, the preferred concentration in the wash water being about 0.25 to 0.75 percent by weight. Concentrations of less than about 0.5 percent by weight are typically sufficient for good automatic machine dishwashing.

All the ingredients of this invention should be selected so as to provide a detergent which produces little or no foam during machine dishwashing, even in interaction with foamable food soils. Low-foaming or non-foaming ingredients can be used to help provide this freedom from excessive foaming, and, as will be pointed out in more detail subsequently, surfactants with low foaming or even de-foaming properties are added to reduce or control foaming.

The alkaline carbonate salt may be an alkali metal carbonate. Typical of the alkali metal carbonates which can be employed in the compositions of the present invention are the alkali metal carbonates; bicarbonates; sesquicarbonates; and mixtures thereof. Illustrative of such carbonates are lithium carbonate, sodium carbonate, potassium carbonate, ammonium carbonate, sodium bicarbonate, ammonium bicarbonate, potassium bicarbonate, sodium sesquicarbonate, and mixtures thereof. Preferably the sodium salts are used for solid and the potassium salts for liquid detergents.

Surprisingly, it has been found that when these carbonate salts are used in compositions of the invention they do not leave undesirable amounts of precipitates on the surface of the articles being washed. These alkali metal carbonate salts are used in amounts of from about 50 to 95 weight based on the total formulation. It has been found that a ratio of 1:1 to 1:10 and, preferably, 1:1 to 1:3, carbonate to bicarbonate moiety provides adequate cleaning without excessive spotting or filming. Higher ratios of carbonate to bicarbonate tend to increase spotting and filming. The pH of these formulations will be in the mildly alkaline 9.0 to 10.0 pH range. This provides an additional advantage over conventional products in mildness to the skin.

The alkaline condensed phosphate salts used herein are also well known to those engaged in the detergent industry. The alkaline condensed phosphate salt may be any alkaline condensed phosphate salt but are preferably sodium or potassium tripolyphosphate, hexametaphosphate, pyrophosphate or glassy phosphate salts.

Especially preferred is a technical grade sodium tripolyphosphate which has a typical analysis of 57 percent by weight of ($P_2O_5$) ion and a molecular weight of 367.9 which is manufactured and sold by FMC Corporation. Also especially preferred is a glassy sodium hexametaphosphate which has a typical analysis of 68.9 percent by weight of ($_2O_5$) ion which is manufactured by FMC Corporation and sold under the trademark of "Glass H".

According to the present invention alkaline condensed phosphate salts are used in amounts to provide from about 0.1 to 1.5 percent and, preferably, from about 0.1 to 0.3 percent by weight of ($P_2O_5$) ion. Thus, sodium tripolyphosphate would be employed in amounts of from about 0.2 to 3.0 percent and, preferably, from about 0.2 to 0.5 percent by weight to supply the desired amount of ($P_2O_5$) ion.

The dispersants utilized in the present invention are water soluble salts of polyelectrolytes. Typical of the polyelectrolytes encompassed are homopolymers and copolymers of acrylic acid, methacrylic acid, maleic acid, fumaric acid, itaconic acid, etc. The polyelectrolyte is a polyacrylic acid, polymethacrylic acid, or a copolymer of acrylic and methacrylic acids, said homopolymers and copolymers ranging in molecular weight from about 1,000 up to about 1,000,000.

Particularly suitable water soluble organic polymers for use in this invention are polyelectrolyte polymers such as those derived from acrylic or methacrylic acid. These materials include, for example, polyacrylic acid and the alkali metal salts thereof, polymethacrylic acid and the alkali metal salts thereof. These polymeric compositions may be homopolymers or they may be copolymers with other copolymerizing monomers, such as ethylene, propylene, isobutylene, styrene, a-methylstyrene, vinyl acetate, vinyl formate, alkyl ether, acrylonitrile, methacrylonitrile, vinyl chloride, vinylidene chloride, the alkyl acrylates, the alkyl methacrylates, the alkyl maleates, and the alkyl fumarates, and other olefinic monomers copolymerizable therewith. The copolymers of this type, having at least 50 mole percent of the acrylic or methacrylic acid derivatives, are preferred, and especially when the comonomer is hydrophobic or has no ionizable groups. Polymers of this type may be prepared directly by the polymerization of suitable monomers, or by the post-chemical reaction of other polymers, for example by the hydrolysis of acrylonitrile or methacrylonitrile polymers.

The preferred polymers are polyacrylic acid, polymethacrylic acid, or water-soluble salts thereof having a molecular weight of from 1,500 to 10,000 calculated as polyacrylic acid.

The water soluble polymer is included in an amount from about 0.5 to about 5.0 percent by weight, and, preferably, in an amount from about 0.8 to about 2.0 percent by weight on an anhydrous basis.

Additional sequesterants could be added, for example the water-soluble salts of aliphatic hydroxypolycarboxylic acid sequesterants such as citric acid, cyclic aliphatic and aromatic polycarboxcylic acids such as cyclopentane tetracarboxylic acid, and salts of polycarboxcylic acids containing ether links, such as oxydiacetic acid, oxydisuccinic and carboxymethyloxysuccinic acid, and homologues and analogs of these compounds. "ETDA" (ethylenediamine tetraacetate), preferably, in its tetrasodium salt, and its analogs can also be employed. While sodium nitrilotriacetate could be used, there are some questions regarding the environmental acceptability of this agent. Mixtures of two or more of these suitable sequestering agents may be used if desired. These compounds are usually used in water-soluble salt form, particularly as the alkali metal, for example, sodium salts, but it may be possible to use the sequesterants in acid form for neutralization in solution.

The low phosphate machine dishwashing compositions of the present invention also include from about 0.5 percent to about 5.0 percent and, preferably, about 1.0 to 3.0 percent by weight of a foam-suppressing nonionic surfactant. Illustrative of such surfactants are the modified ethyoxylated alcohol or alkyl phenol type, wherein the ethoxylate is modified by replacing the terminal OH group with halogen, for example, chlorine, or alkoxy, or with aryloxy and arylalkyloxyggroups; amine polyglycol condensates; pluronic surfactants obtained by the condensation of ethylene oxide with hydrophobic bases formed by condensing propylene oxide with propylene gylcol, and the like.

Specific nonionic detergent active compounds which can be used in the compositions of the invention include ethoxylated fatty alcohols, preferably linear monohydric alcohols with $C_{10}$–$C_{18}$, preferably $C_{10}$–$C_{15}$, alkyl groups and about 5–15, preferably 7–12, ethylene oxide (EO) units per molecule and ethoxylated alkylphenols with $C_8$–$C_{16}$ alkyl groups preferably $C_8$–$C_9$ alkyl groups, and from about 4–12 EO units per molecule. The nonionic compounds are often used in admixture with minor amounts of other detergent-active compounds especially anionic compounds, to improve their characteristics.

It is preferred to include bleaching agents in the present invention. The preferred bleaching agents employed are classified broadly as oxygen bleaches. Preferrably chlorine bleaches are not utilized herein. The oxygen bleaches are represented by percompounds which are true per-salts or ones which liberate hydrogen peroxide in solution. Preferred examples include sodium- and potassiumperphosphates, perborates, percarbonates, and monopersulfates. The persulfates, particularly sodium persulfate, are especially preferred.

The oxygen bleach is employed in amounts of from 0 to about 6.0, and preferably, from about 1.0 to 5.0 percent by weight of the detergent formulation.

The peroxygen bleach may be used in conjunction with an activator therefor. Sodium bromide is a preferred activator when persulfates are used. Polyacylated compounds may also be used with persulfate or other peroxygen bleaches as activators; among these, compounds such as tetraacetyl ethylene diamine ("TAED") and pentaacetyl glucose are particularly preferred. Other useful activators include, for example, acetyl-salicylic acid derivatives, ethylidene benzoate acetate and its salts, alkyl and alkenyl succinic anhydride, tetraacetyl-glycouril ("TAGU"), and the derivatives of these.

Corrosion inhibitors can be added. Soluble silicates are highly effective inhibitors and can be added to certain formulas of this invention at levels of from about 3 percent to about 8 percent by weight. Alkali metal silicates, preferably, potassium or sodium silicates having a weight ratio of $SiO_2$:$M_2O$ of from about 1:1 to 2.8:1 can be used. M in this ratio refers to sodium or potassium. A sodium silicate having a ratio of $SiO_2$:$Na_2O$ of about 1.6:1 to 2.45:1 is especially preferred for economy and effectiveness.

A useful bleaching composition containing peroxygen bleaches capable of yielding hydrogen peroxide in an aqueous solution and specific bleach activators at specific molar ratios of hydrogen peroxide to bleach activator is disclosed in Chung et al U.S. Pat. No. 4,412,934 assigned to The Proctor & Gamble Company.

Additionally small amounts of conventional adjuvants such as perfumes, colorants, chlorinated bleaches, bacterial agents or other similar adjuvants can suitably be employed.

Such conventional additives are employed, generally in the amount of about 0 to 5.0, preferably 1 to 5.0 percent by weight. Such additives may also include aluminates and silicates for protection of the china, and foam suppressors.

Evidence of the effectiveness of the novel automatic dishwasher detergent compositions of the present invention is presented hereinafter with a view to providing illustrative compositions within the purview of the present invention. The person skilled in the art will readily appreciate that the specific embodiments in the following examples and illustrations are just that, illustrative and not unduly restrictive. Accordingly, the following examples further illustrate the machine dishwashing compositions and the dishwashing process of the present invention. Unless otherwise stated, all percentages and parts are by weight.

EXAMPLE I-IV

A series of automatic dishwasher detergent compositions were prepared having the formulations set forth in Table I which follows:

TABLE I

| Example Component | Example Number Percent by Weight I | II | III | IV** |
|---|---|---|---|---|
| Sodium Tripolyphosphate ($P_2O_5$)* | 0.0 | 0.2 (0.114) | 0.5 (0.285) | 33.0 (18.81) |
| Sodium Carbonate | 21.5 | 21.5 | 21.5 | 21.0 |
| Sodium Polyacrylate | 1.0 | 1.0 | 1.0 | — |
| Sodium Citrate (hydrous) | 2.0 | 2.0 | 2.0 | — |
| Sodium Persulfate | 3.0 | 3.0 | 3.0 | — |
| Sodium Bromide | 1.0 | 1.0 | 1.0 | — |
| Nonionic Surfactant | 1.5 | 1.5 | 1.5 | 2.0 |
| Sodium Bicarbonate | 70.0 | 69.8 | 69.5 | — |
| Sodium Silicate | — | — | — | 22.7 |
| ACL-59 (chlorinating agent) | — | — | — | 2.0 |
| Sodium Sulfate | — | — | — | 19.0 |
| Fragrance | — | — | — | 0.3 |
| TOTAL | 100.0 | 100.0 | 100.0 | 100.0 |

*Percent by weight expressed as ($P_2O_5$) ion.
**Approximate estimate of components in Cascade Automatic Diswasher Detergent (Mfg. by Proctor & Gamble).

The compositions identified in Table I were tested for spotting and filming in order to illustrate their ability to retard or prevent formation of spots or film on dishes. The procedure utilized was "Automatic Dishwashing Detergent Evaluation Method"—ASTM-D3556 wherein performance is evaluated utilizing water having a hardness of 250 ppm as $CaCO_3$. The ratings range from "1" which represents no spotting and/or filming to "5" which represents severe spotting and/or filming.

The results of such tests are shown in the table below.

| Evaluation | Example Number I | II | III | IV |
|---|---|---|---|---|
| Spotting | 3.0 | 2.5 | 2.0 | 2.1 |
| Filming | 5.0 | 3.8 | 3.3 | 3.1 |

These results illustrate that it is possible to achieve overall efficacy, especially on glassware spotting and filming, comparable to the current high phosphate automatic dishwasher detergents with a formula containing tripoly- phosphate levels as low as 0.5 percent by weight (0.285 percent by weight expressed as ($P_2O_5$) used in conjunction with a polyacrylate polymer, sodium bicarbonate and sodium carbonate. Surprisingly, these desirable ratings were made with a composition containing a low level of phosphate not expected to soften water enough to produce this effect as shown by the above noted hard water laboratory tests wherein a marked improvement in glassware spotting and filming is achieved by adding just 0.2 percent by weight tripolyphosphate (0.114 percent by weight expressed ($P_2O_5$) ion) to a composition. An even more significant improvement is achieved by raising the tripoly- phosphate addition level to just 0.5 percent by weight or 0.285 percent by weight ($P_2O_5$) ion to achieve parity with high phosphate automatic dishwasher detergents.

While this invention has been described with reference to certain specific embodiments, it will be recognized by those skilled in the art that many vriations are possible without departing from the scope and spirit of the invention and it will be understood that it is intended to cover all changes and modifications of the invention disclosed herein for the purposes of illustration which do not constitute departures from the spirit and scope of the invention.

What is claimed is:

1. A low phosphate automatic dishwashing composition comprising from about 50 to 95 percent by weight of alkali metal carbonate and bicarbonate salts wherein such salts comprise a weight ratio of about 1:1 to 1:10 carbonate to bicarbonate, a sufficient amount of an alkaline condensed phosphate salt to provide from about 0.1 to 1.5 percent by weight of ($P_2O_5$) ion, from about 3 to 5.0 percent by weight of polycarboxylate polymer of molecular weight from 1,000 to 1,000,000, and from about 0.5 to 5.0 percent by weight of a nonionic surfactant.

2. The composition of claim 1 wherein said composition contains from about 1.0 to 3.0 percent by weight of a foam-suppressing nonionic surfactant and from about 0 to about 6.0 percent by weight of an oxygen bleach.

3. The composition of claim 1 wherein the alkali metal carbonate and bicarbonate salts comprise a weight ration of about 1:3 carbonate to bicarbonate.

4. The composition of claim 1 wherein the alkali metal carbonate is sodium carbonate, potassium carbonate, or mixtures thereof.

5. The composition of claim 1 wherein the alkali metal bicarbonate is sodium bicarbonate, potassium bicarbonate, or mixtures thereof.

6. The composition of claim 1 wherein the alkali condensed phosphate salt is sodium or potassium tripolyphosphate, hexametaphosphate or pyrophosphate.

7. The composition of claim 1 wherein the polycarboxylate polymer is an alkali metal or ammonium salt of acrylic or methacrylic polyelectrolyte polymers.

8. The composition of claim 1 wherein the polycarboxylate polymer is a water-soluble salt of an aliphatic hydroxy polycarboxcylic acid.

9. The composition of claim 2 wherein an activator is employed with said oxygen bleach.

10. The composition of claim 1 wherein up to about 8 percent by weight of a corrosion inhibitor is employed.

* * * * *